US008276321B2

(12) United States Patent
Bell

(10) Patent No.: US 8,276,321 B2
(45) Date of Patent: Oct. 2, 2012

(54) EXPANDED METAL GUTTER COVER AND METHOD OF INSTALLATION

(75) Inventor: Robert Benjamin Bell, Douglasville, GA (US)

(73) Assignee: Euramax International, Inc., Norcross, GA (US)

( * ) Notice: Subject to any disclaimer, the term of this patent is extended or adjusted under 35 U.S.C. 154(b) by 17 days.

(21) Appl. No.: 12/545,555

(22) Filed: Aug. 21, 2009

(65) Prior Publication Data

US 2011/0041414 A1 Feb. 24, 2011

(51) Int. Cl.
*E04D 13/00* (2006.01)

(52) U.S. Cl. ..... 52/12; 52/670

(58) Field of Classification Search ..... 52/11, 12, 52/670, 672; 248/48.1
See application file for complete search history.

(56) References Cited

U.S. PATENT DOCUMENTS

| | | | | | |
|---|---|---|---|---|---|
| 4,092,808 | A * | 6/1978 | Maloney et al. | 52/11 |
| 4,604,837 | A | 8/1986 | Beam | 52/12 |
| 5,305,562 | A | 4/1994 | Sapia | 52/12 |
| 5,471,798 | A | 12/1995 | Kuhns | 52/12 |
| 5,737,879 | A | 4/1998 | Sweet | 52/12 |
| 5,813,173 | A * | 9/1998 | Way, Sr. | 52/12 |
| 6,067,755 | A | 5/2000 | Maanum | 52/12 |
| 6,151,837 | A | 11/2000 | Ealer | 52/12 |
| 6,412,228 | B1 | 7/2002 | Meckstroth | 52/12 |
| 6,598,352 | B2 * | 7/2003 | Higginbotham | 52/12 |
| 6,672,012 | B2 | 1/2004 | Bahroos | 52/11 |
| 6,883,760 | B2 | 4/2005 | Seise | 248/481 |
| 6,944,991 | B2 | 9/2005 | Kim | 52/11 |
| 6,951,077 | B1 * | 10/2005 | Higginbotham | 52/12 |
| 7,627,991 | B1 * | 12/2009 | Feldhaus | 52/12 |
| 7,870,692 | B2 * | 1/2011 | Gregg | 52/12 |
| 2006/0107603 | A1 * | 5/2006 | Brownridge | 52/11 |
| 2006/0179723 | A1 * | 8/2006 | Robins | 52/11 |
| 2006/0265968 | A1 * | 11/2006 | Lowrie, III | 52/11 |
| 2007/0107323 | A1 * | 5/2007 | Higginbotham | 52/120 |
| 2008/0010906 | A1 * | 1/2008 | Brochu | 52/12 |
| 2008/0134587 | A1 * | 6/2008 | Ealer | 52/12 |

* cited by examiner

*Primary Examiner* — William Gilbert
*Assistant Examiner* — Gisele Ford
(74) *Attorney, Agent, or Firm* — Miller Law Group, PLLC

(57) ABSTRACT

A gutter cover is formed through expanded metal manufacturing techniques to create alternating areas of solid metal and diamond-shaped openings to facilitate the shedding of leaves while passing water into the gutter. The gutter cover is mounted without fasteners by securing a hook portion underneath the front lip of the gutter and arcing the body portion of the gutter cover to press the rearward drip foot against the gutter and the drip hip adjacent to the fascia board into a pressure fit. The length of the gutter cover from the rearward edge to the front end being slightly longer than the corresponding length of the gutter structure. The gutter cover includes an integral drip leg projecting downwardly from the drip hip and being formed with an area of expanded metal diamond-shaped apertures to direct water into the gutter trough. A front drip lip directs water away from the gutter face.

17 Claims, 14 Drawing Sheets

20
R
33
34
31
21
22
30
35
B
36
38
13
39
16
17
15
14
12
12
10
11

Fig. 7
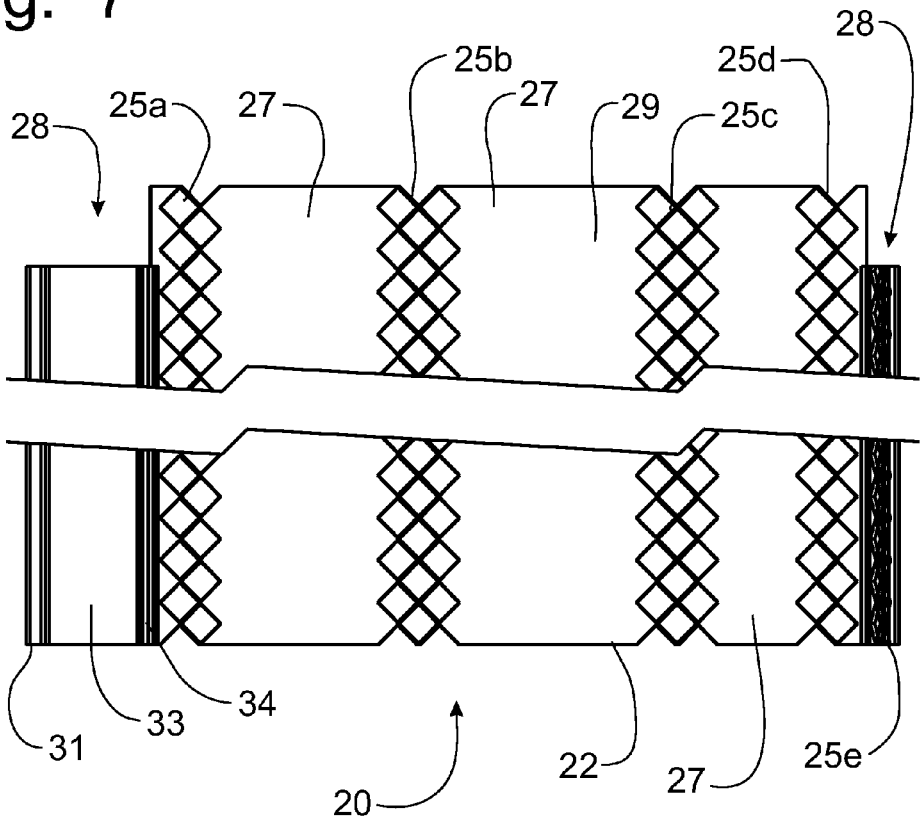
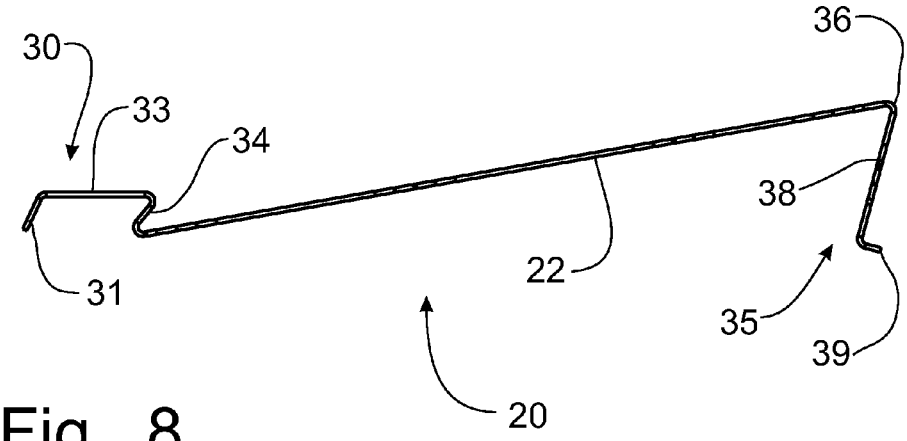
Fig. 8

Fig. 9
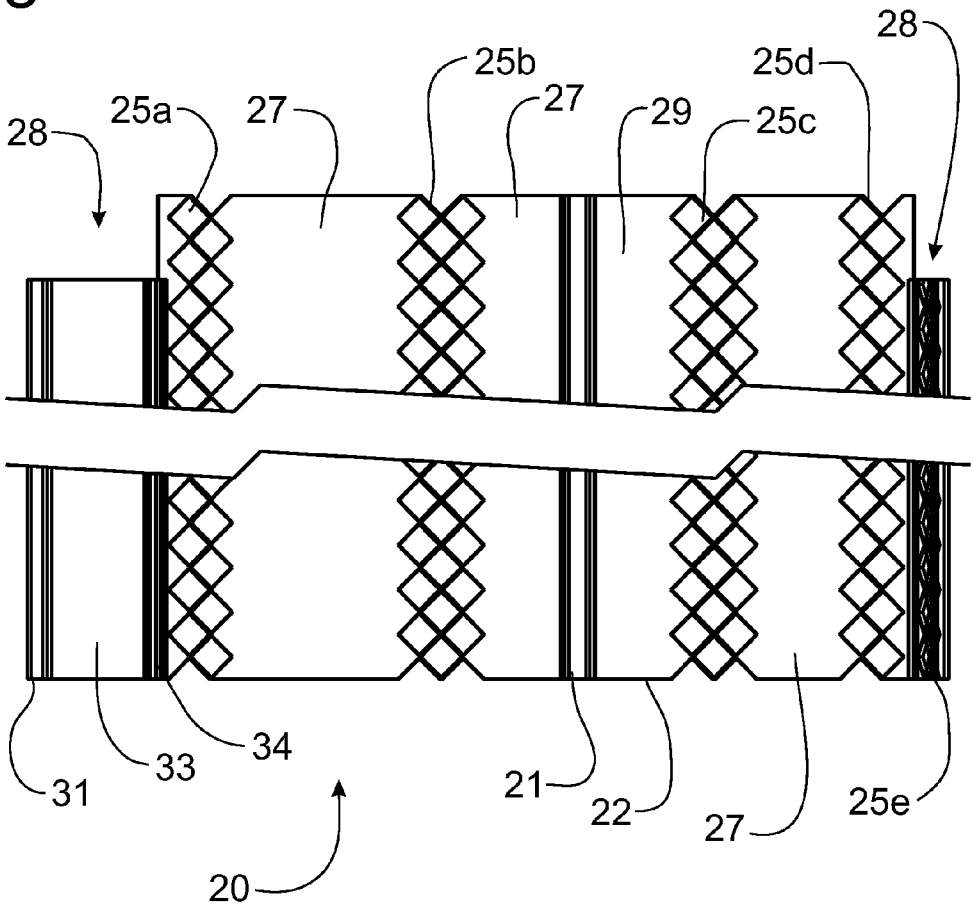
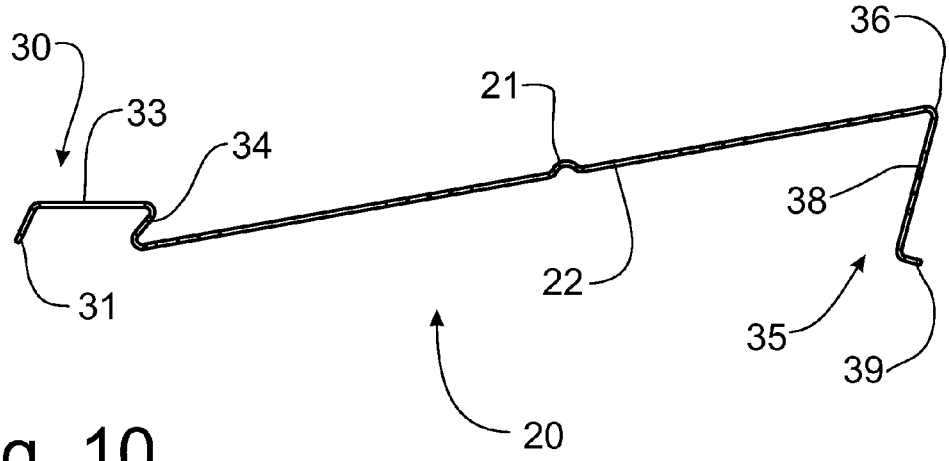
Fig. 10

Fig. 11
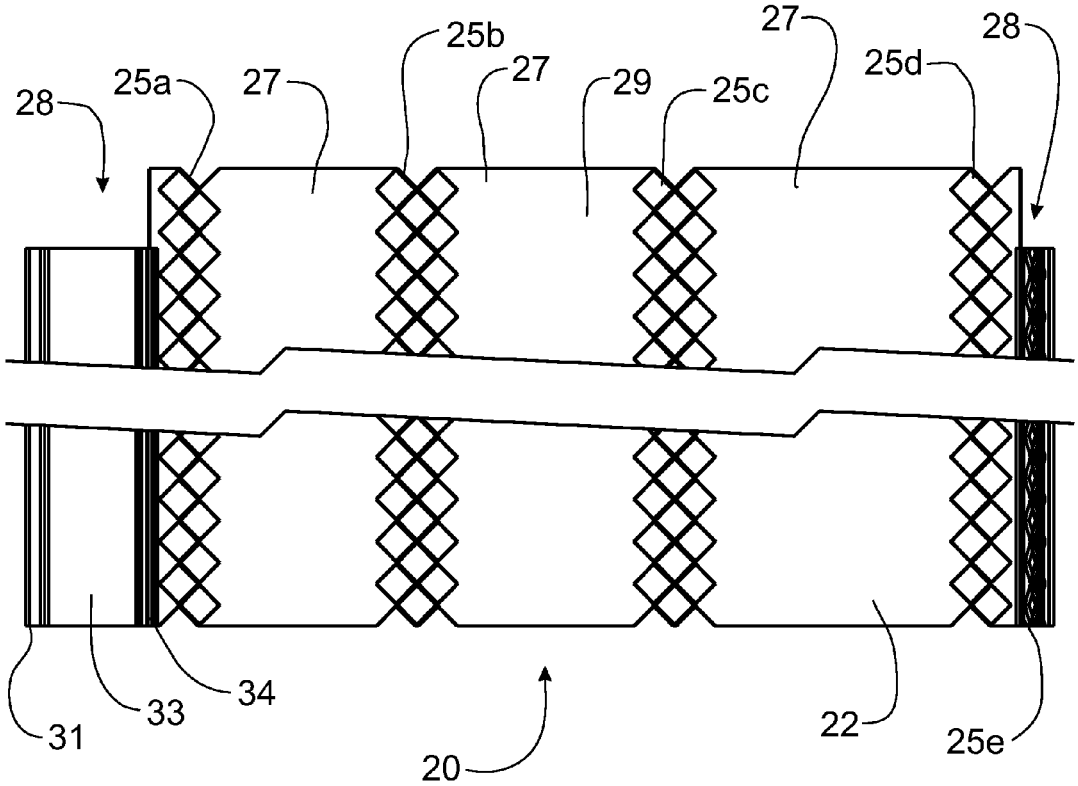
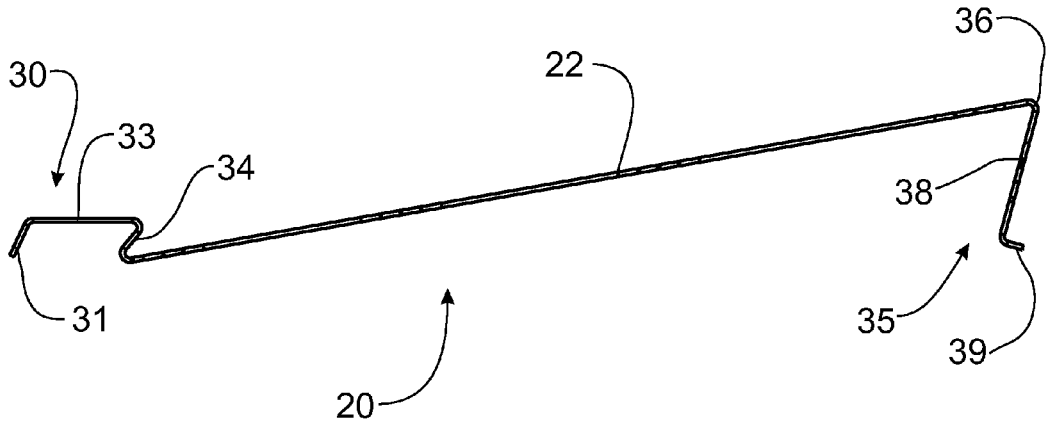
Fig. 12

Fig. 13
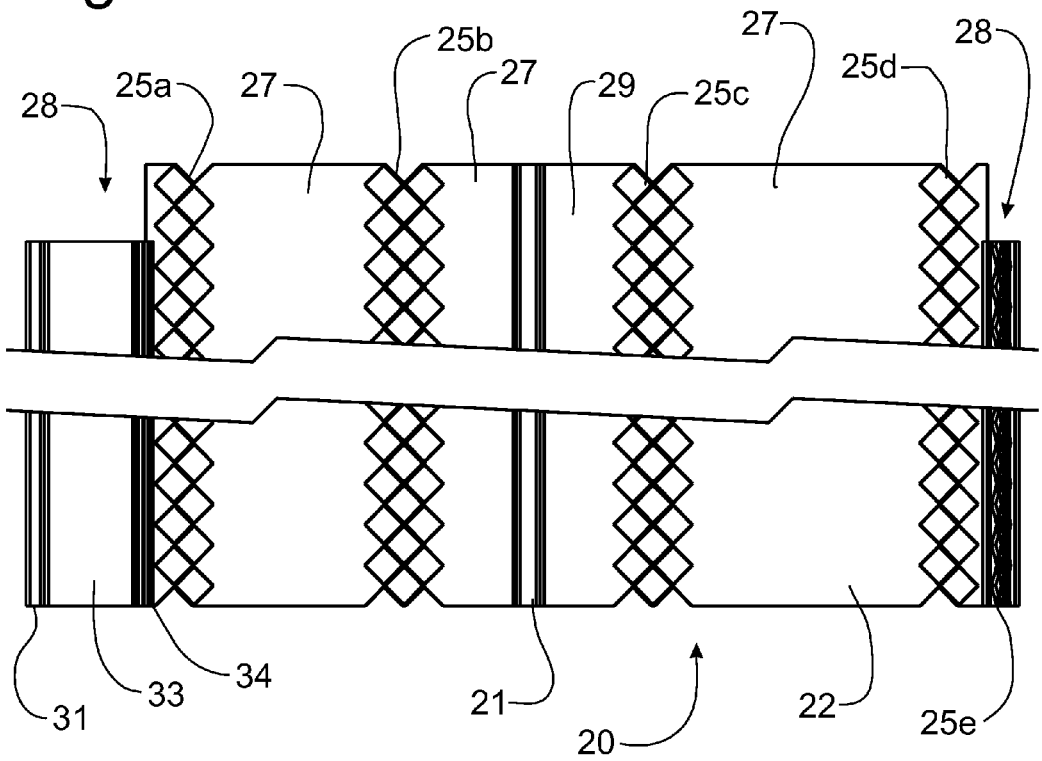
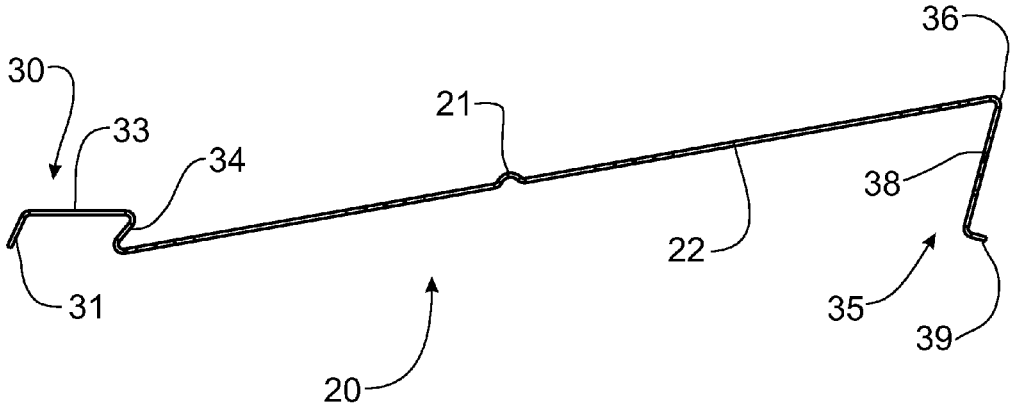
Fig. 14

Fig. 15
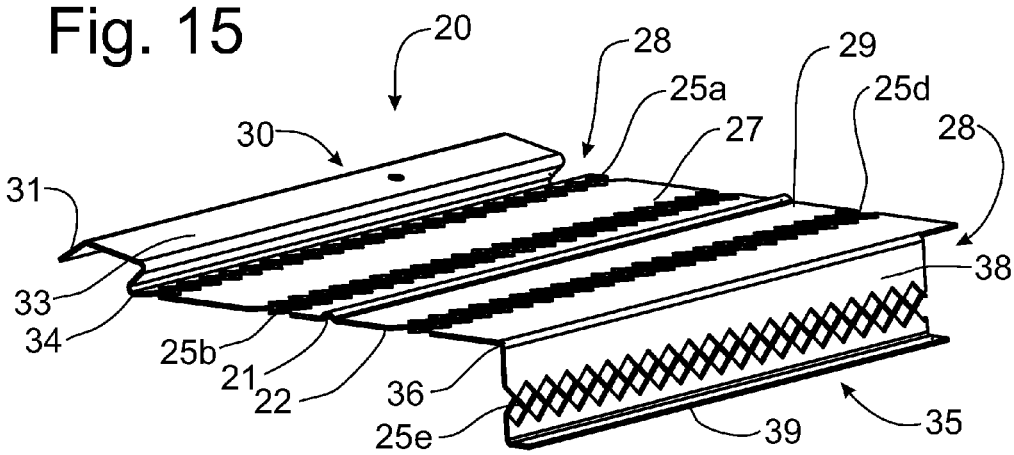
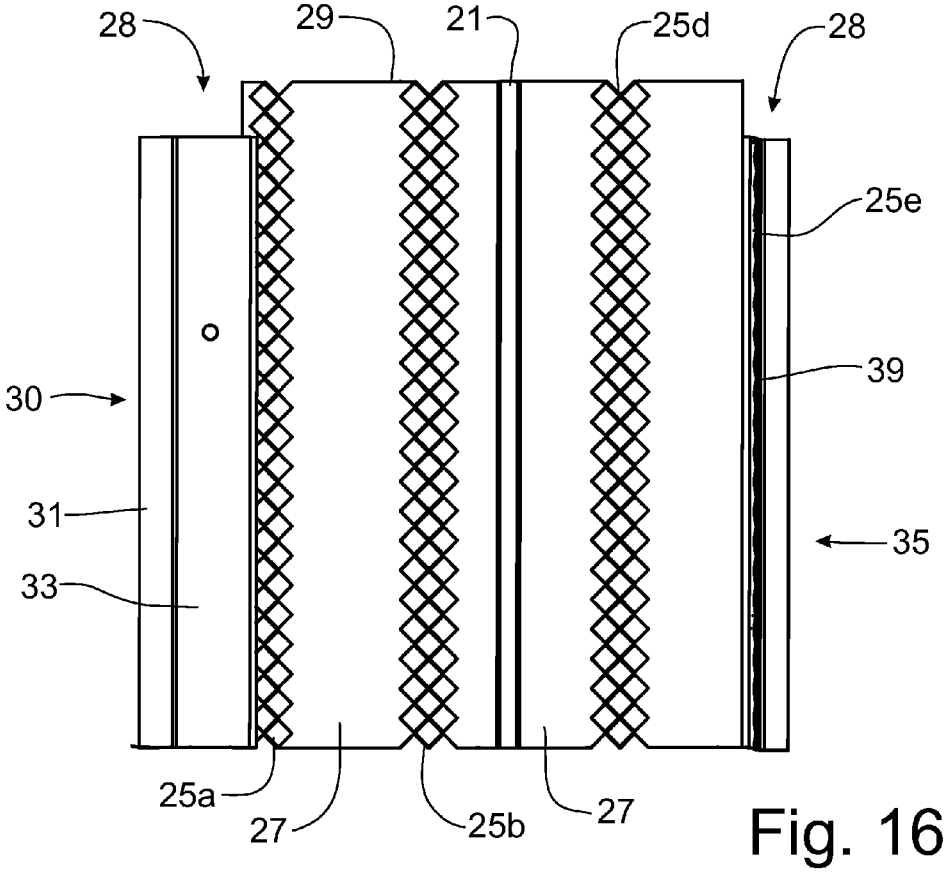
Fig. 16

EXPANDED METAL GUTTER COVER AND METHOD OF INSTALLATION

FIELD OF THE INVENTION

This invention relates generally to a cover for a gutter mounted at the edge of the roof of a building to received water draining off of the roof, the cover preventing the entry of leaves and debris into the gutter while allowing the passage of water and, more particularly, to a gutter cover that has openings therein formed by expanded metal techniques for the passage of water and a gutter cover that is mounted to the gutter without need of fasteners.

BACKGROUND OF THE INVENTION

Gutters and downspouts are mounted on most residential and commercial structures along the lower edge of the roof of the structure to receive water draining off of the roof, such as during a rainstorm. Gutters come in many different styles, including K gutter, half round gutter, or commercial box gutter, but all are generally formed with an open top through which water is received into a trough or channel that delivers the water by gravity to a downspout for discharge away from the building structure. The presence of leaves and debris in the gutter trough will often clog the gutter and the downspout, preventing water from draining down the downspout and away from the building structure. Gutters are often mounted on a plurality of hangers that are spaced along the length of the gutter and fastened to fascia boards by nails or screws such that the gutter is suspended from the hangers.

Gutter covers are mounted on the top of the gutter, usually by screws spaced along the length of the front lip of the gutter. Gutter covers come in many configurations. Some have openings in the cover for water to pass into the gutter trough, while others are solid with a curved front edge that allows water to follow the curve into the gutter trough while leaves and debris are discharged off the cover away from the gutter. One such gutter cover can be seen in U.S. Pat. No. 6,672,012, granted to Gobind Bahroos et al, on Jan. 6, 2004, wherein the curved front edge allows water to pass into the gutter trough. This gutter cover disclosed in the Bahroos patent is mounted under the shingles at the roof line to extend over the gutter trough. Some gutter covers combine the solid configuration with a curved front end and an apertured portion, such as is found in U.S. Pat. No. 6,883,760, granted on Apr. 26, 2005, to John Seise, Jr., where the gutter cover is mounted under the shingles and provides a portion with holes to allow the passage of water off the rounded nose into the gutter trough. A similar gutter cover, but having holes through the entire cover, is found in U.S. Pat. No. 6,944,991, issued to Hyun Kim on Sep. 20, 2005.

In U.S. Pat. No. 6,151,837, granted to James Ealer on Nov. 28, 2000, the gutter cover is supported between the front lip of the gutter and wedged under the shingles along the edge of the roof. The Ealer gutter cover has a solid portion next to the roof edge and a plurality of channels and slots formed in the lower portion to allow the passage of water through the gutter cover into the gutter trough. The channels in the Ealer gutter cover are formed of the material in the sheet metal member and direct water outwardly toward the front lip of the gutter. In U.S. Pat. No. 5,471,798 issued to Richard Kuhns on Dec. 5, 1995, the gutter cover is formed in a box-like configuration with the roof side being mounted under the shingles and fastened to the gutter by mounting screws. The gutter cover in U.S. Pat. No. 5,305,562, granted to John Sapia on Apr. 26, 1994, has a similar configuration.

Other gutter covers, such as is disclosed in U.S. Pat. No. 6,067,755, issued on May 30, 2000, to Armand Maanum simply form a cover that extends from the roof line directly to the front lip of the gutter with the body of the gutter cover being formed with diagonal slots that allow the passage of water into the gutter trough. Not all gutter covers are mounted under the shingles at the roof line, as can be seen in U.S. Pat. No. 5,737,879, granted on Apr. 14, 1998, to Vernon Sweet, where the roof side of the gutter cover is fastened by nails to the fascia board underneath the roof edge. A solid gutter cover with a rounded front edge can also be mounted to the gutter, as is disclosed in U.S. Pat. No. 4,604,837, issued on Aug. 12, 1986, to Tony Beam, where the back edge of the gutter cover is fastened to the gutter and to the fascia board by nails passing through the gutter and gutter cover.

In U.S. Pat. No. 6,412,228, issued to Alan Meckstroth on Jul. 2, 2002, the gutter cover is formed with a rounded front edge to urge water into the gutter trough, but also incorporates a drip lip at the forward edge of the gutter cover to direct water away from the front face of the gutter. A second drip lip is provided under the gutter cover to direct water coming through the gutter cover into the trough instead of along the fascia board. This drip edge, as well as the gutter cover is mounted underneath the shingles at the front edge of the roof.

It would be desirable to provide a gutter cover that would be operable to effectively drain water into the gutter trough while preventing leaves and debris from entering the gutter trough. It would also be desirable to provide a gutter cover than can be easily mounted on the gutter structure without requiring the use of fasteners to retain the gutter cover in position on the gutter.

SUMMARY OF THE INVENTION

It is an object of this invention to overcome the disadvantages of the prior art by providing a gutter cover that can be mounted on a gutter structure without requiring the use of fasteners.

It is another object of this invention to provide a gutter cover having alternating solid portions and portions with apertures to facilitate the shedding of leaves and debris while allowing the passage of rainwater into the gutter trough.

It is a feature of this invention that the apertures through the gutter cover are formed through expanded metal manufacturing techniques.

It is another feature of this invention that the apertures are diamond shaped.

It is an advantage of this invention that the diamond shaped apertures enhance surface tension and cohesion to pull the water through the apertures and into the gutter trough.

It is still another feature of this invention that the gutter cover is formed with alternating solid and apertured portions extending transversely to the flow of water from the roof to the front lip of the gutter cover.

It is another advantage of this invention that the solid portions of the gutter cover enhance the shedding of leaves and debris off the surface of the gutter cover.

It is still another feature of this invention that the gutter cover incorporates an integral drip leg extending downwardly from the rearward portion of the gutter cover to deflect water into the gutter trough.

It is still another advantage of this invention that the drip leg incorporates an orthogonal foot member bent toward the back of the gutter to engage the gutter hangers.

It is yet another feature of this invention that the drip leg is formed with apertures along the lower end of the downwardly extending drip leg extension.

It is yet another advantage of this invention that the apertures in the drip leg are formed through expanded metal manufacturing techniques to allow any water that might seep behind the gutter cover will attach itself through surface tension onto the drip leg and flow downwardly into the expanded holes and into the gutter trough.

It is another advantage of this invention that the expanded drip leg structure provides extra protection against water flowing behind the gutter and damaging or defacing the fascia board.

It is still another object of this invention to provide a gutter cover that is formed with a rearward drip hip from which a downward drip leg extends, and a front hook portion that is shaped to lock underneath the front lip of the gutter to secure the front portion of the gutter cover to the gutter without fasteners.

It is yet another object of this invention to provide a gutter cover that can be mounted on a standard gutter structure without requiring the use of fasteners to secure the gutter cover to the gutter structure.

It is yet another feature of this invention that the gutter cover has a longitudinal width dimension measured from the rear edge to the front edge that is longer than the corresponding distance of the gutter structure.

It is a further advantage of this invention that the gutter cover is mounted on the gutter structure by engaging the rear drip foot against the gutter and the rear drip hip adjacent to the fascia board, with the front hook portion under the front lip of the gutter to cause an arc in the gutter cover that creates a pressure fit between the fascia board and the front lip of the gutter.

It is a further feature of this invention that the forward portion of the gutter cover incorporates a front drip lip forwardly of the hook portion to direct water away from the front face of the gutter.

It is still a further object of this invention to provide a gutter cover to keep leaves and debris out of a gutter, which is durable in construction, inexpensive of manufacture, carefree of maintenance, facile in assemblage, and simple and effective in use.

These and other objects, features and advantages are accomplished according to the instant invention by providing a gutter cover for mounting on the top of a gutter to keep the leaves and debris out of the gutter trough. The gutter cover is formed through expanded metal manufacturing techniques to create alternating areas of solid metal and diamond-shaped openings to facilitate the shedding of leaves off the gutter cover while allowing the passage of water into the trough. The gutter cover is mounted without fasteners by securing a hook portion underneath the front lip of the gutter and arcing the body portion of the gutter cover to press the rearward drip foot against the gutter and the drip hip adjacent to the fascia board into a pressure fit. The length of the gutter cover from the rearward edge to the front end being slightly longer than the corresponding length dimension of the gutter structure. The gutter cover includes an integral drip leg projecting downwardly from the drip hip and being formed with an area of expanded metal diamond-shaped apertures to help direct water into the gutter trough.

BRIEF DESCRIPTION OF THE DRAWINGS

The advantages of this invention will become apparent upon consideration of the following detailed disclosure of the invention, especially when taken in conjunction with the accompanying drawings wherein:

FIG. 7 is a top plan view of a first embodiment of the gutter cover corresponding to a five inch wide gutter, the central portion of the gutter cover being broken away for purposes of clarity and to indicate an indeterminate length;

FIG. 8 is an side elevational view of the gutter cover shown in FIG. 7;

FIG. 9 is a top plan view of a second embodiment of the gutter cover corresponding to a five inch wide gutter and having a central reinforcing rib, the central portion of the gutter cover being broken away for purposes of clarity and to indicate an indeterminate length;

FIG. 10 is an side elevational view of the gutter cover shown in FIG. 9;

FIG. 11 is a top plan view of a third embodiment of the gutter cover corresponding to a six inch wide gutter, the central portion of the gutter cover being broken away for purposes of clarity and to indicate an indeterminate length;

FIG. 12 is an side elevational view of the gutter cover shown in FIG. 11;

FIG. 13 is a top plan view of a fourth embodiment of the gutter cover corresponding to a six inch wide gutter with a longitudinal reinforcing rib, the central portion of the gutter cover being broken away for purposes of clarity and to indicate an indeterminate length;

FIG. 14 is an side elevational view of the gutter cover shown in FIG. 13;

FIG. 15 is a rear perspective view of the second embodiment of the gutter cover incorporating the principles of the instant invention; and FIG. 16 is a top plan view of the gutter cover shown in FIG. 16.

DETAILED DESCRIPTION OF THE PREFERRED EMBODIMENT

Figure 1:
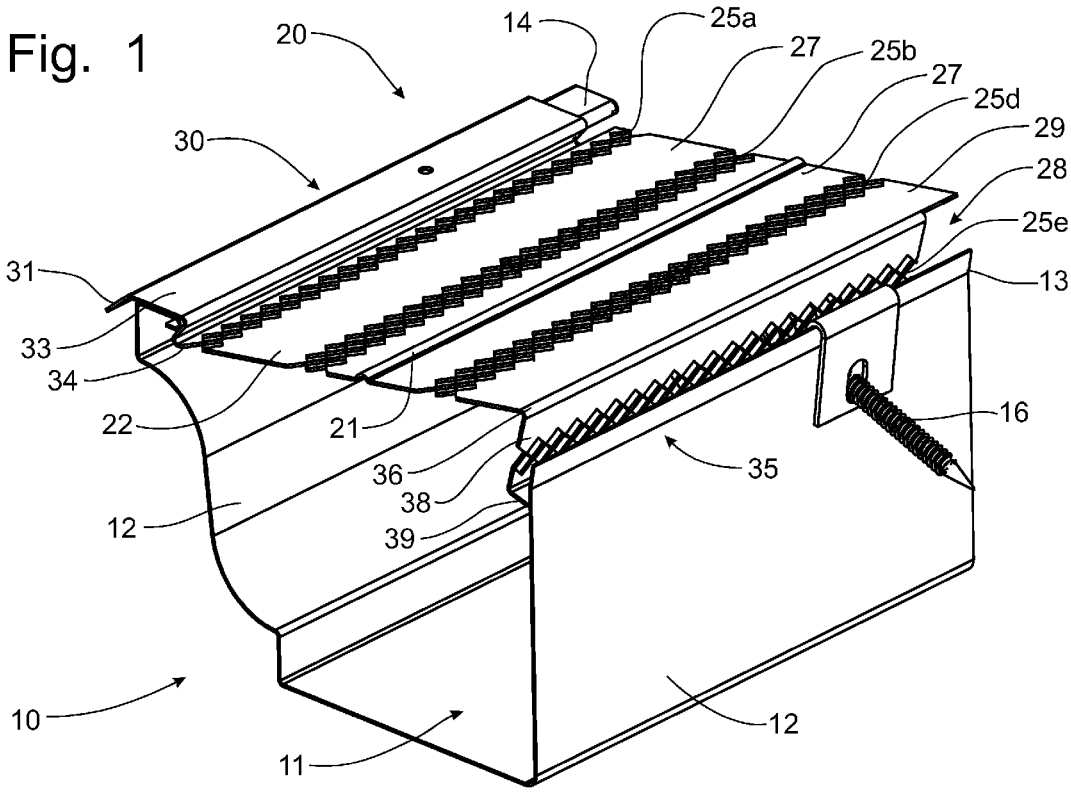
FIG. 1 is a rear perspective view of a representative section of a gutter having a gutter cover incorporating the principles of the instant invention mounted on top of the gutter, a representative gutter hanger having a fastener driven through it for engagement with a fascia board or other building frame support located behind the gutter.

Referring now to FIGS. 1-5 and 7-16, a several similar embodiments of a gutter cover incorporating the principles of the instant invention can best be seen. In each embodiment of the invention, the gutter cover 20 is mounted on top of a gutter 10 to prevent the entry of leaves and debris into the trough 11 of the gutter 10, which will be carried to the down spout (not shown) and can clog the down spout and gutter system, rendering them ineffective to remove rain water discharged off of the roof of the building to which the gutter is mounted. Although the gutter can be formed in a variety of shapes, including K gutter, half round gutter, or commercial box gutter, all are formed with upright side walls 12 having a rear edge 13 attached to the building B and a front lip 14 spaced from the rear edge 13 to define an open top into which rain water falls from the roof R to be carried away by the trough 11. Typically, the gutter 10 is supported by a hanger member 15 which engages the front lip 14 and is affixed to the building structure B by a fastener 16 that often passes through the rearward edge 13 of the gutter 10 to secure both the rearward part of the gutter 10 and the hanger member 15 to the building structure B, which is best seen in FIGS. 6A-6D.

The gutter cover 20 is preferably formed in two different configurations, each of which preferably comes in different standard sizes to fit most configurations of gutters 10 which come in 4 inch, 5 inch, 6 inch, 7 inch and 8 inch wide systems. The five and six inch versions of the two different configurations (with a transversely extending reinforcing rib 23 or without the reinforcing rib 23) are reflected in FIGS. 7-14. Irrespective of the configuration, the gutter cover 20 is formed through expanded metal manufacturing techniques, as is found in U.S. Pat. No. 6,629,016, granted to Jeffrey Smith on Sep. 30, 2003, and assigned to Amerimax Diversified Products Inc. This manufacturing technique can produce areas containing rows of shaped expanded metal openings in sheet metal by controlling the incremental advance of the feeding mechanism along with the timing and location of the cutter/expander.

Figure 2:
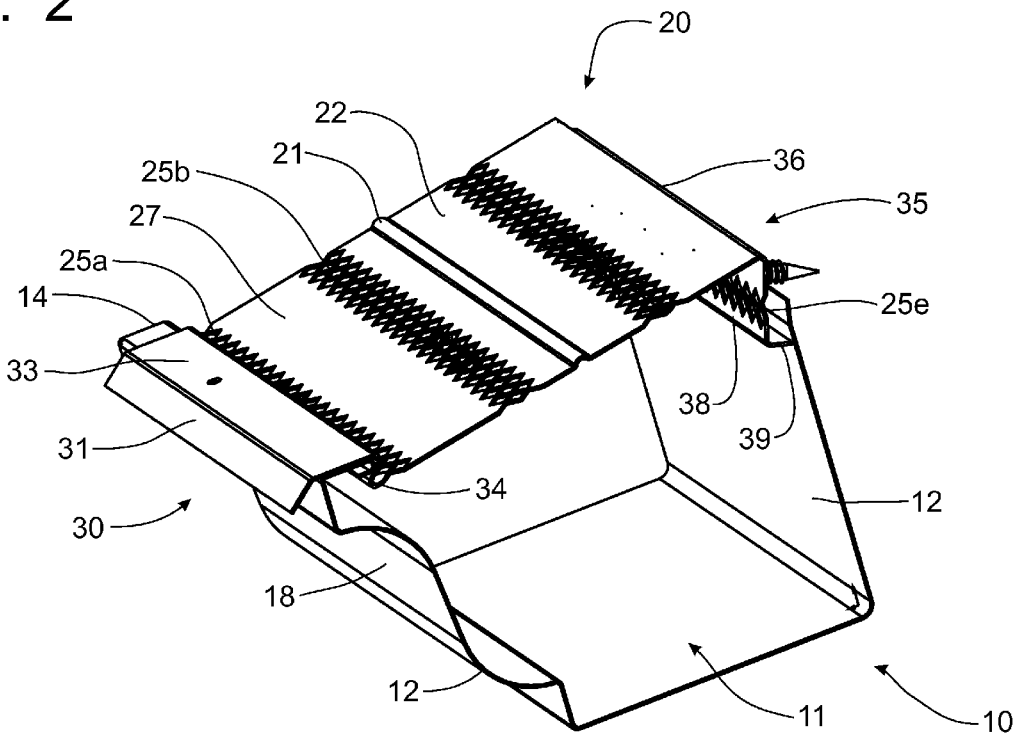
FIG. 2 is a front perspective view of the gutter having a gutter cover mounted thereon as shown in FIG. 1.
Figure 3:
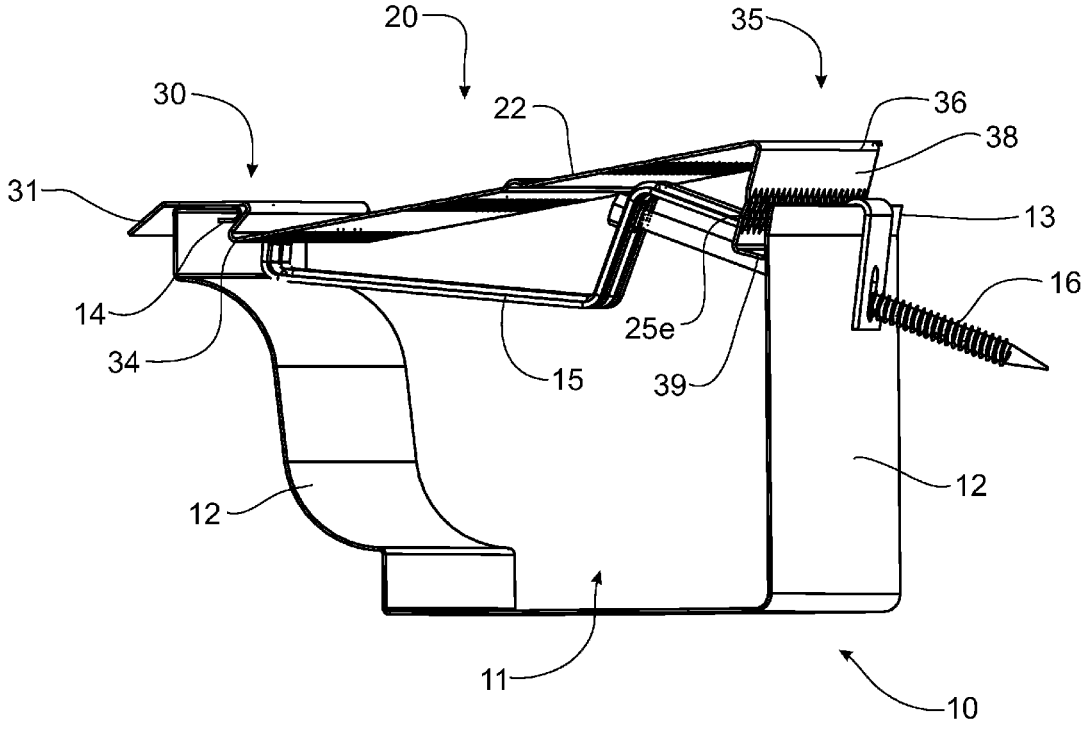
FIG. 3 is a side perspective view of the gutter and gutter cover shown in FIG. 1.
Figure 4:
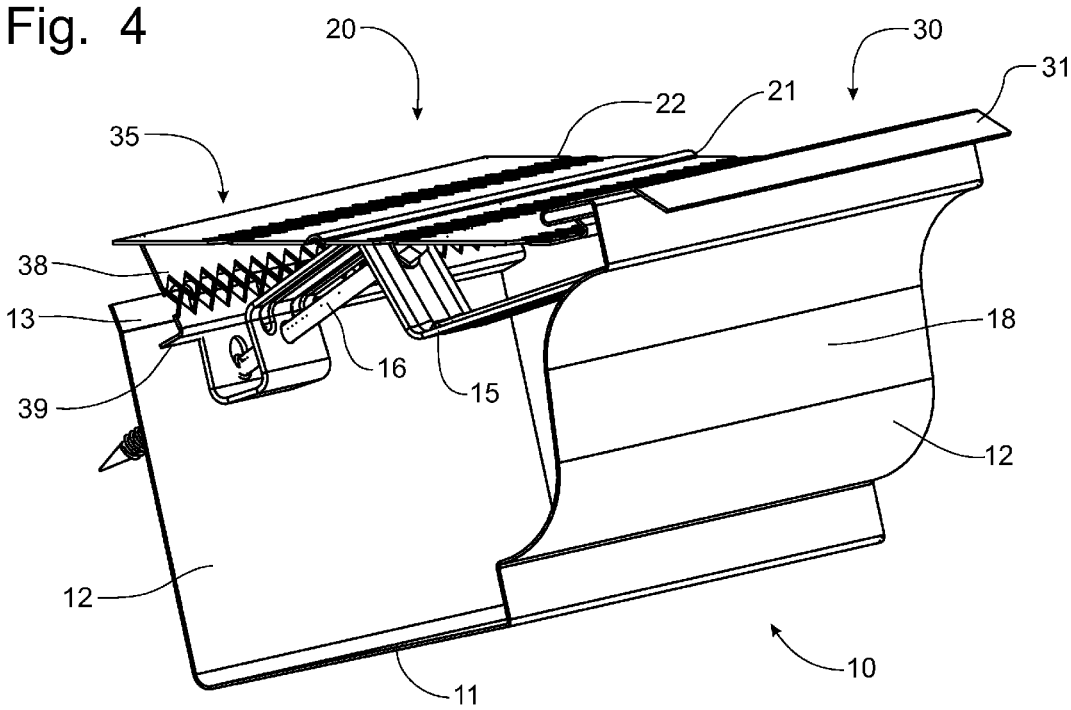
FIG. 4 is a lower, front perspective view of the gutter and gutter cover shown in FIG. 1.
Figure 5:
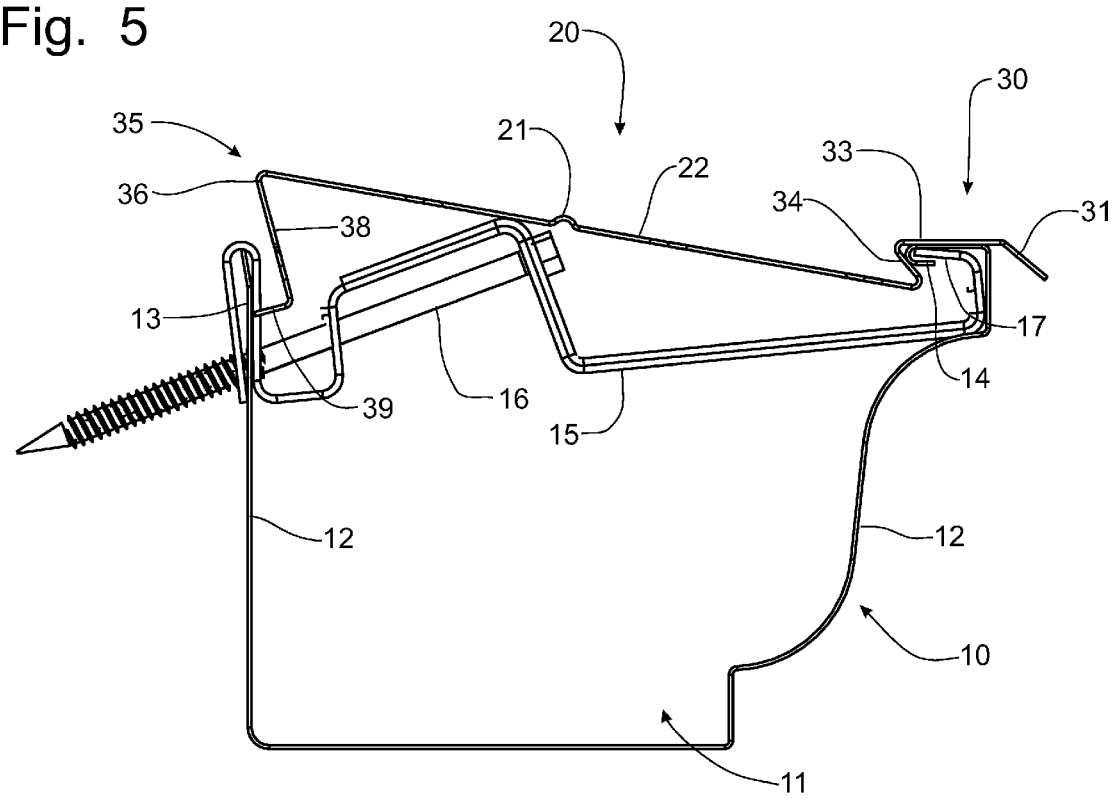
FIG. 5 is a cross-sectional view of the gutter having a gutter cover mounted thereon, as shown in FIG. 1, the representative gutter hanger being shown in profile.

The gutter cover 20 starts as a strip of sheet metal into which are formed a plurality of transversely extending areas 25 formed of rows of diamond-shaped apertures, preferably four of five areas 25, separated by non-apertured areas of sheet metal 27. Preferably, a forwardmost area 25*a* of diamond-shaped apertures is formed for location immediately rearward of the hook portion 34, as will be defined in greater detail below, a rearwardmost area 25*e* of diamond-shaped apertures is formed into the drip leg 38, as will also be defined in greater detail below. The central areas of apertures 25*b*, 25*c* and 25*d* are located in the generally planar body portion 22 of the gutter cover 20 with the rearwardmost central area 25*d* being located immediately forwardly of the drip hip portion 36 of the gutter cover 10 where the drip leg 38 extends downwardly from the body portion 22. As can be seen in FIGS. 1, 2 and 16, the longitudinal length, i.e. the distance in the direction from the drip leg 38 toward the hook portion 34, of each of the non-apertured areas 27, is preferably greater than the longitudinal length of either of the apertured areas 25 adjacent thereto, and is clearly greater than the negligible spacing between any of the individual rows of apertures within the areas of expanded metal openings. The areas 25 of diamond-shaped apertures allow the passage of rainwater through the gutter cover 20, while the solid areas 27 facilitate the movement of leaves and other debris over the body portion 22 of the gutter cover 10 for discharge over the front portion 30 of the gutter cover 20.

The front portion 30 of the gutter cover 20 is bent after the formation of the areas of apertures 25 of expanded metal openings to create a front drip lip 31, a generally planar cap portion 33 and an S-shaped hook portion 34 which is connected to the body portion 22 of the gutter cover 20. Similarly, the rear portion 35 of the gutter cover 20 is bent to form a drip leg 38, a drip hip 36, which is the bend between the body portion 22 and the drip leg 38 and an orthogonally bent drip foot 39. The drip leg 38 is preferably bent through an interior angle of between 75 degrees and 100 degrees relative to the body portion 22. Optionally, the body portion 22 can be formed with a transversely formed reinforcing rib 23 formed in the central solid part 27 to stiffen the body portion 22. Preferably, the overall length of the gutter cover 20 is approximately a quarter to a third of an inch longer than the corresponding dimension of the gutter 10 so that the gutter cover 20 will form a pressure fit between the front lip 14 and the rear edge 13 of the gutter 10 when mounted thereon, as will be described in greater detail below.

The drip lip 31 is preferably bent at about 40 degrees with respect to the planar cap portion 33 to project outwardly from the front lip 14 of the gutter 10 so that any rain water, as well as any leaves and debris discharged off the gutter cover 20, are directed outwardly away from the front face 18 to minimize streaking and discoloration of the front face 18 of the gutter 10. The planar cap portion 33 is sized to fit over top of the return on the front lip 14, which in turn captures the front edge 17 of the hanger member 15. The integral hook portion 34 is formed through a double bend to capture the front lip 14 and to recess the forward part of the body portion 22 below the level of the cap portion 33 and the front lip 14. With the forwardmost area 25*a* of diamond-shaped apertures located adjacent the hook portion 34, any rainwater traversing the more rearward areas 25*b*-25*d* of apertures will fall into the gutter trough 11 to be carried to the down spout (not shown).

The rear portion 35 of the gutter cover 20 is bent to form the drip hip 36, the drip leg 38 and the drip foot 39 as described above. The area 25*e* of expanded metal apertures in the drip leg 38 allows any water that might seep behind the gutter cover 20 will attach to the drip leg 38 through surface tension and flow downwardly into the apertured area 25*e*. Once water enters into the area 25*e*, the surface tension will be dissipated and the water will drop into the gutter trough 11. The provision of the integral drip leg 38 provides extra protection against water flowing behind the rear wall 13 of the gutter 10 to damage or deface the supporting building structure B, such as the fascia board.

The gutter cover 20 is preferably manufactured in discrete transverse lengths, such as 36 inches, 48 inches or 60 inches long, lengths that will allow the gutter cover 20 to be easily handled by an installer. Since gutters 10 extend along the length of roofs having much greater lengths than the intended length of each gutter cover 20, an installer will need to install multiple gutter covers 20 at each typical installation. Each gutter cover 20 is formed with a pair of male notches 28 at the front and rear portions 30, 35 to leave the body portion 22 as a central protruding section 29 between the male notches 28. The male notches 28 could extend into the body portion 22 to remove the forwardmost or rearwardmost areas 25*a* and 25*d* and leave only the central part of the body portion 22 as the central protruding section 29. When two lengths of gutter covers 20 are mounted end to end on a gutter 10, the flush end of the gutter cover 20 is overlapped with respect to the central protruding section 29 so that the respective front portions 30 and rear portions 35 will abut. The overlapping of the body portions 22 of the adjacent gutter covers 20 helps to keep all gutter cover members 20 in place through synergy of the system. Every gutter cover member 20 is connected to at least one other gutter cover member 20, which protects the gutter cover members 20 from becoming dislodged.

Figure 6A:
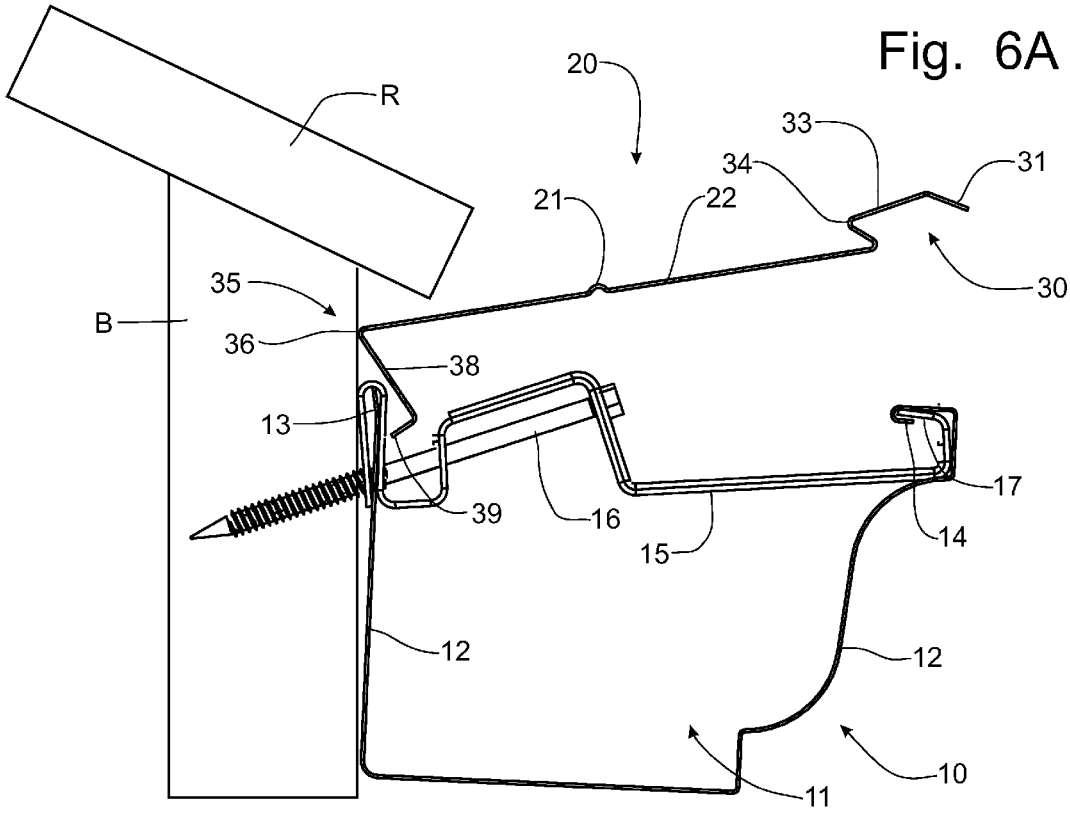
FIG. 6A is a cross-sectional, side elevational view of the gutter affixed to a building frame support through a gutter hanger fastened to the frame support, the gutter cover being engaged at the rear of the gutter to initiate the gutter cover installation procedure.
Figure 6B:
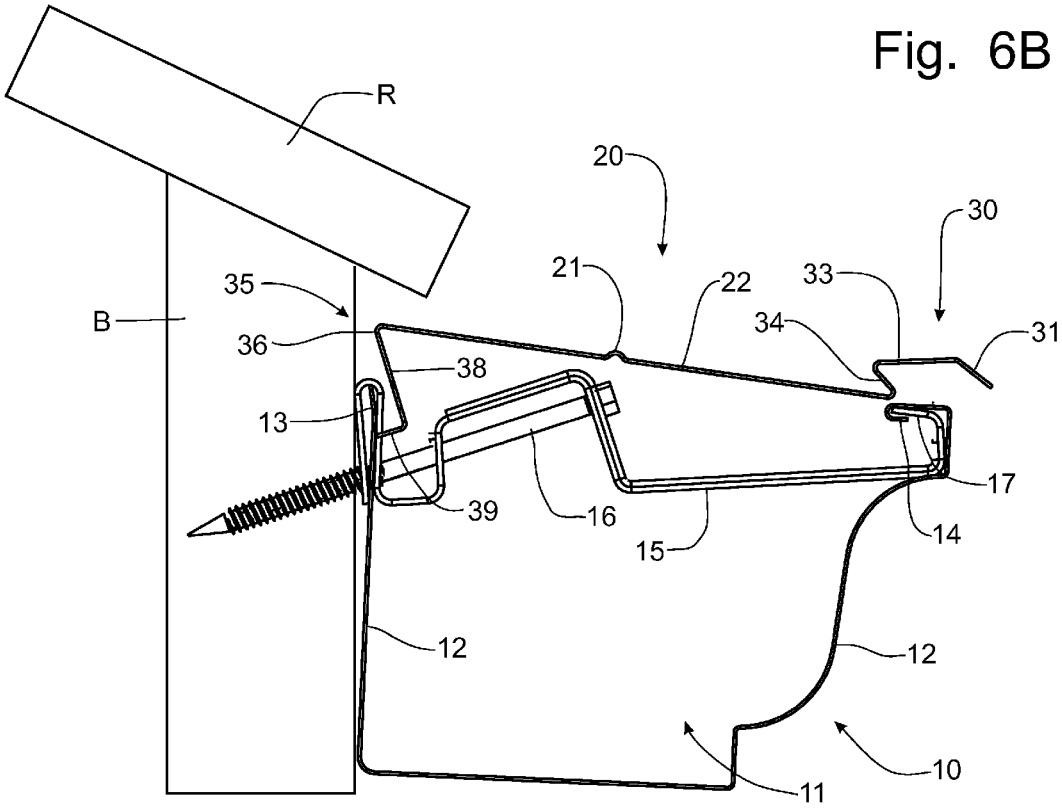
FIG. 6B is a cross-sectional, side elevational view similar to that of FIG. 6A, but showing the movement of the front portion of the gutter cover toward the front lip of the gutter.
Figure 6C:
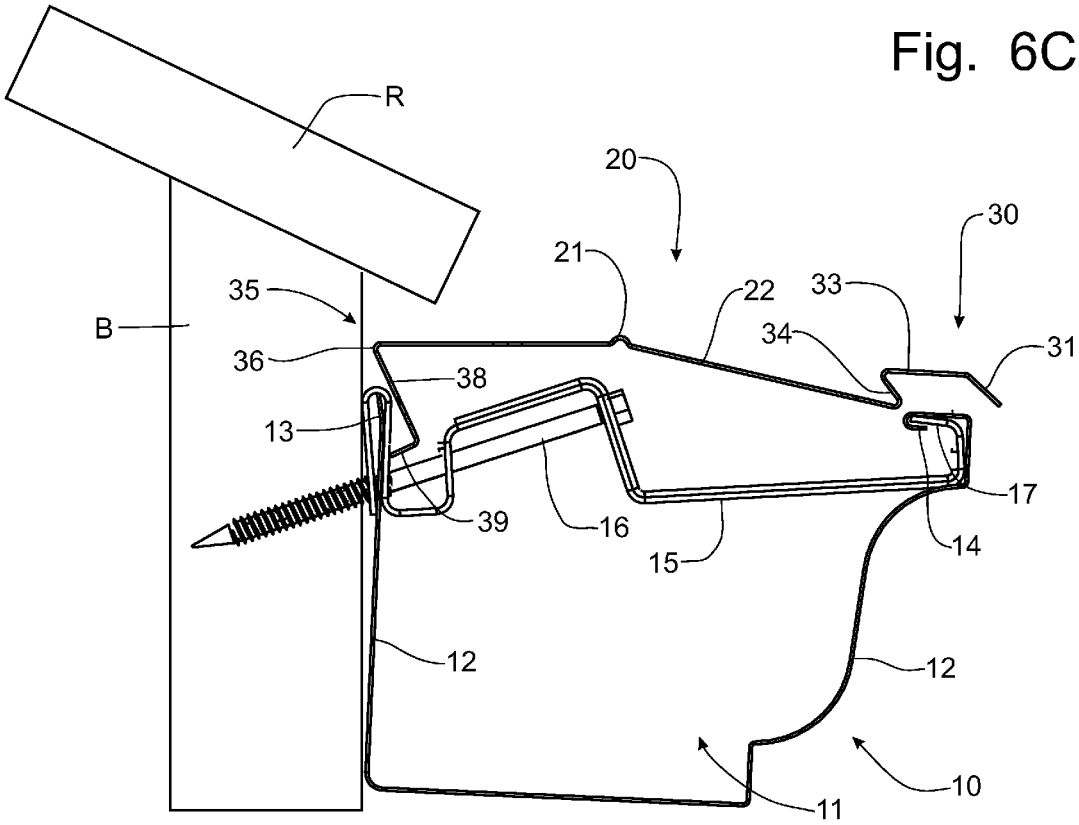
FIG. 6C is a cross-sectional, side elevational view similar to that of FIG. 6B, but showing the flexing of the gutter cover to enable the hook member to clear the front lip of the gutter and permit engagement therewith.

During the initial stage of installation, as is depicted in FIG. 6A, the drip hip 36 of the gutter cover 20 is positioned adjacent to the fascia board B, leaving virtually no space between the gutter cover 20 and the fascia board B, which provides an extraordinary amount of protection against leaves, debris and other foreign objects entering the gutter trough 11. The drip foot 39 is then rotated downwardly, as depicted in FIG. 6B, and toward the fascia board B by pushing on the front of the gutter guard 10. At this point, the drip foot 39 should be sitting on and engaged with the gutter hanger members 15. The drip hip, however, may be separated slightly from the fascia board, or pressed snuggly against the fascia board, depending on how the gutter is installed. The primary pressure points are the drip foot, which is located below the hook part of the gutter hanger to place downward pressure on the drip foot and to minimize the chance of the rear portion 35 of the gutter cover 20 walking up the gutter. The gutter cover 20 is preferably formed from a high tensile strength metal alloy, such as aluminum, so that the gutter cover 20 can be pressure fit into the gutter 10. As the gutter cover is pressed inwardly, the high tensile strength metal will bow slightly, as depicted in FIG. 6C, thereby shrinking the overall width dimension.

Figure 6D:
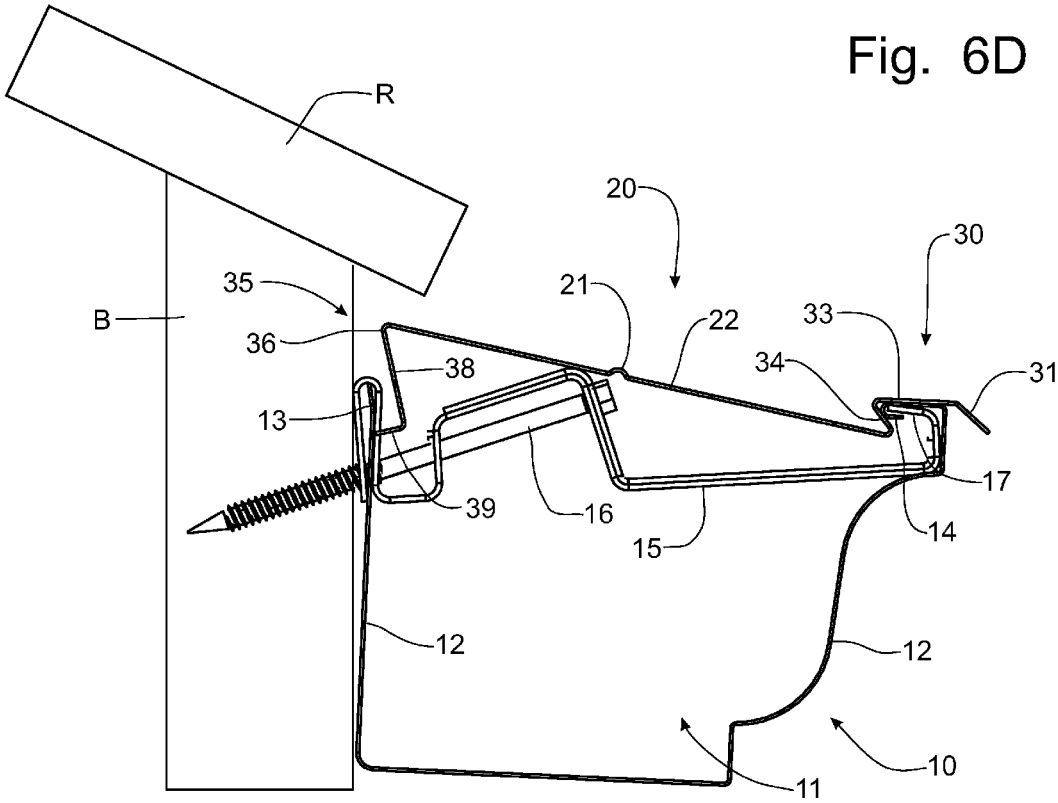
FIG. 6D is a cross-sectional, side elevational view similar to that of FIG. 6C, but showing the gutter cover placed into a pressure fit on the gutter with the rear portion of the gutter cover pressing against the rear of the gutter and the front hook member of the gutter cover being secured underneath the front lip of the gutter.

The front hook member 34 can then clear the front lip 14 and secure the gutter cover 20 on the gutter 10, as is depicted in FIG. 6D. The gutter cover 20 will then be pressed down to allow the hook portion 34 to snap into place on the undercarriage of the gutter front lip 14. Once the gutter cover 20 is securely hooked to the gutter front lip 14, the pressure between the hook portion 34, the drip hip 36, and drip foot 39, created by the additional quarter inch of length of the gutter cover 20 compared to the corresponding dimension of the gutter 10 to hold the gutter cover 20 tightly in place on the gutter 10 without the need for additional screws or fasteners. Accordingly, the gutter cover 20 is held in a static position on the gutter 10 through its own installation method without using hangers or screws. The engagement of the drip foot 39 with the gutter hangers 15 and with the back edge 13 of the gutter 10 prevents the gutter cover 20 from "walking" or becoming unlocked or disengaged from its pressure fit area.

The gutter cover 20 can be manufactured from a number of high tensile strength metal alloys, including metal substrates of aluminum, zinc, galvanized steel, galvalume, galvanneal, copper, stainless steel in mill finish and coated finishes, including but not limited to, polyester, PVC, Hylar, Kynar, anodize, tin/zinc and Teflon. One skilled in the art will also recognize that the diamond-shaped apertures with the expanded metal framework extending diagonally serves to disrupt surface tension of water droplets moving longitudinally across the gutter cover 20 toward the front portion 30 to facilitate the dropping of water through the apertured areas 25. However, one skilled in the art will recognize that the formation of the expanded metal openings is not limited to being diamond-shaped, as other geometric shapes can be formed according to the teaching of the aforementioned U.S. Pat. No. 6,629,016, and utilized as alternative configurations in the manufacturing of the gutter covers 20 according to the principles of the instant invention.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A gutter cover for mounting on a gutter attached to a building and having a gutter trough to receive water discharged from a roof structure of said building comprising:

a central body portion formed of alternating areas of expanded metal openings and non-apertured areas, each area of expanded metal openings including more than one transversely extending row of openings, each said non-apertured area having a longitudinal dimension greater than a longitudinal dimension between two adjacent rows of openings in either of the areas of expanded metal openings proximate to the non-apertured area, said central body portion having at least two areas of expanded metal openings separated by a non-apertured area, the longitudinal dimension of each said area of expanded metal openings being less than the corresponding longitudinal dimension of said non-apertured area separating said at least two areas of expanded metal openings;

a front portion integrally formed with said central body portion and being configured to be supported on a front lip portion of said gutter; and a rear portion integrally formed with said body portion and including a drip leg bent downwardly from said body portion toward said gutter trough.

2. The gutter cover of claim 1 wherein said drip leg is formed with an area of expanded metal openings.

3. The gutter cover of claim 2 wherein said drip leg terminates in a drip foot bent rearwardly from said drip leg so as to be directed away from said front portion.

4. The gutter cover of claim 2 wherein said front portion includes:

a hook member connected to said central body portion and being engagable under said front lip portion of said gutter to trap said hook member on said front lip portion of said gutter.

5. The gutter cover of claim 4 wherein said front portion further includes:

a cap portion extending forwardly of said hook member to overlie said front lip portion of said gutter; and a drip lip extending forwardly of said cap portion and being bent at an angle to said cap portion to define a drip edge that projects outwardly from said gutter.

6. The gutter cover of claim 4 wherein said areas of expanded metal openings include:

a first area of expanded metal openings located adjacent said hook member;

a second area of expanded metal openings located rearwardly of said first area and being separated from said first area of expanded metal openings by a first non-apertured area;

a third area of expanded metal openings located rearwardly of said second area of expanded metal openings located proximate to said rear portion; and a second non-apertured area between said second and third areas of expanded metal openings.

7. The gutter cover of claim 6 wherein said second non-apertured area is formed with a transversely extending reinforcing rib.

8. The gutter cover of claim 4 wherein said expanded metal openings are formed in a diamond shape having an apex oriented toward said drip leg to intercept water flow over said central body portion.

9. A combination of a gutter for mounting on a building adjacent a roof structure terminating in a roof edge to collect water discharged from the roof edge and a gutter cover for mounting on said gutter to prevent leaves and debris from entering a trough portion of said gutter, said gutter having a front lip portion and a rear edge portion, the improvement comprising:

said gutter cover being formed with an integral drip leg projecting downwardly from a body portion of said gutter cover toward said gutter trough to engage said rear edge portion of said gutter to provide a spring force exerted against said rear edge portion of said gutter to retain the gutter cover on said gutter without requiring fasteners connecting said drip leg to said rear edge portion of said gutter, said drip leg being formed with a transversely extending area of expanded metal openings having more than one transversely extending row of openings and at least one non-apertured area adjacent said area of expanded metal openings, said body portion being formed with a plurality of transversely extending areas of expanded metal openings separated by non-apertured areas, each area of expanded metal openings including more than one transversely extending row of openings.

10. The combination of claim 9 wherein said gutter cover includes a formed front portion including a hook member connected to said body portion and being engagable under said front lip portion of said gutter to trap said hook member on said front lip portion of said gutter.

11. The combination of claim 10 wherein said front portion further includes:

a cap portion extending forwardly of said hook member to overlie said front lip portion of said gutter; and a drip lip extending forwardly of said cap portion and being bent at an angle to said cap portion to define a drip edge that projects outwardly from said gutter.

12. The combination of claim 10 wherein said areas of expanded metal openings include:

a first area of expanded metal openings located adjacent said hook member;

a second area of expanded metal openings located rearwardly of said first area and being separated from said first area of expanded metal openings by a first non-apertured area;

a third area of expanded metal openings located rearwardly of said second area of expanded metal openings located proximate to said rear portion; and a second non-apertured area between said second and third areas of expanded metal openings.

13. The combination of claim 12 wherein said expanded metal openings are formed in a diamond shape having an apex oriented in a longitudinal direction to intercept water flow over said body portion.

14. The combination of claim 12 wherein said second non-apertured area is formed with a transversely extending reinforcing rib.

15. A gutter for mounting on a building adjacent a roof structure terminating in a roof edge to collect water discharged from the roof edge, comprising:

a gutter trough positioned beneath said roof edge to receive water discharged therefrom, said gutter trough having a formed front lip and a rear edge portion, said gutter trough being supported on a hanger member passing through said rear edge portion and engaged into said building; and a gutter cover mounted on said gutter trough to prevent leaves and debris from entering said gutter trough, said gutter cover including:

a central body portion formed of alternating areas of expanded metal openings and non-apertured areas, each area of expanded metal openings including more than one transversely extending row of openings, each said non-apertured area located between said areas of expanded metal openings having a longitudinal dimension greater than a longitudinal dimension between two adjacent rows of openings in either of the areas of expanded metal openings proximate to the non-apertured area and also greater than the longitudinal dimension of each respective area of expanded metal openings adjacent thereto;

a front portion integrally formed with said central body portion and including a hook member connected to said body portion and being engagable under said front lip to trap said hook member on said front lip; and a rear portion integrally formed with said body portion and including a drip leg bent downwardly from said body portion toward said gutter trough, said drip leg engaging said rear edge portion of said gutter to provide a spring force urging said hook member onto said front lip of said gutter.

16. The gutter of claim 15 wherein said drip leg terminating in a drip foot bent rearwardly from said drip leg so as to be directed away from said front portion, said drip foot being engaged with said hanger member while said hook member is engaged with said front lip portion of said gutter to create a pressure fit of said gutter cover on said gutter.

17. The gutter of claim 16 wherein said drip leg is formed with a transversely extending area of expanded metal openings having more than one transversely extending row of openings and at least one non-apertured area adjacent said area of expanded metal openings.

* * * * *